US008398221B2

(12) United States Patent
Xie et al.

(10) Patent No.: US 8,398,221 B2
(45) Date of Patent: Mar. 19, 2013

(54) PRINTING USING LIQUID FILM POROUS CATCHER SURFACE

(75) Inventors: Yonglin Xie, Pittsford, NY (US); Qing Yang, Pittsford, NY (US); Roger S. Kerr, Brockport, NY (US); Chang-Fang Hsu, Beavercreek, OH (US)

(73) Assignee: Eastman Kodak Comapny, Rochester, NY (US)

( * ) Notice: Subject to any disclaimer, the term of this patent is extended or adjusted under 35 U.S.C. 154(b) by 310 days.

(21) Appl. No.: 12/843,907

(22) Filed: Jul. 27, 2010

(65) Prior Publication Data

US 2012/0026253 A1 Feb. 2, 2012

(51) Int. Cl.
*B41J 2/185* (2006.01)
*B41J 2/02* (2006.01)

(52) U.S. Cl. ..... 347/90; 347/77

(58) Field of Classification Search ..... 347/73–83, 347/90, 91

See application file for complete search history.

(56) References Cited

U.S. PATENT DOCUMENTS

| | | | | |
|---|---|---|---|---|
| 4,024,548 | A | 5/1977 | Alonso et al. | |
| 4,460,903 | A | 7/1984 | Guenther et al. | |
| 4,636,808 | A | 1/1987 | Herron | |
| 6,079,821 | A | 6/2000 | Chwalek et al. | |
| 6,457,807 | B1 | 10/2002 | Hawkins et al. | |
| 6,478,414 | B2 | 11/2002 | Jeanmaire | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,588,888 | B2 | 7/2003 | Jeanmaire et al. | |
| 6,793,328 | B2 | 9/2004 | Jeanmaire | |
| 6,820,970 | B2 | 11/2004 | Long | |
| 6,827,429 | B2 | 12/2004 | Jeanmaire et al. | |
| 6,851,796 | B2 * | 2/2005 | Jeanmaire et al. | 347/74 |
| 6,863,384 | B2 | 3/2005 | Jeanmaire | |
| 7,520,598 | B2 | 4/2009 | Xu et al. | |
| 7,938,516 | B2 | 5/2011 | Piatt et al. | |
| 2008/0278549 | A1 | 11/2008 | Xu et al. | |

OTHER PUBLICATIONS

Xu et al., U.S. Appl. No. 12/468,077, filed May 19, 2009.
Xie et al., U.S. Appl. No. 12/468,075, filed May 19, 2009.
Xie et al., U.S. Appl. No. 12/468,079, filed May 19, 2009.
Guan et al., U.S. Appl. No. 12/468,076, filed May 19, 2009.
Hsu et al., U.S. Appl. No. 12/504,050, filed Jul. 16, 2009.

* cited by examiner

*Primary Examiner* — Kevin S Wood
(74) *Attorney, Agent, or Firm* — William R. Zimmerlo

(57) ABSTRACT

A method of printing provides liquid drops travelling along a first path using a jetting module. A catcher including a stationary porous surface is also provided. A liquid film is caused to flow over the stationary porous surface of the catcher using a liquid source. Selected liquid drops are caused to deviate from the first path and begin travelling along a second path using a deflection mechanism. The liquid drops travelling along one of the first path and the second path contact the liquid film.

19 Claims, 10 Drawing Sheets

PRINTING USING LIQUID FILM POROUS CATCHER SURFACE

CROSS REFERENCE TO RELATED APPLICATIONS

Reference is made to commonly-assigned, U.S. patent applications Ser. No. 12/843,910, entitled "LIQUID FILM MOVING OVER POROUS CATCHER SURFACE", Ser. No. 12/843,906 , entitled "LIQUID FILM MOVING OVER SOLID CATCHER SURFACE", Ser. No. 12/843,909, entitled "PRINTING USING LIQUID FILM SOLID CATCHER SURFACE", all filed concurrently herewith.

FIELD OF THE INVENTION

This invention relates generally to the field of digitally controlled printing systems, and in particular to continuous printing systems.

BACKGROUND OF THE INVENTION

Continuous inkjet printing uses a pressurized liquid source that produces a stream of drops some of which are selected to contact a print media (often referred to a "print drops") while other drops are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and are allowed to strike a print media. Alternatively, deflected drops can be allowed to strike the print media, while non-deflected drops are collected in the capturing mechanism.

Drop placement accuracy of print drops is critical in order to maintain image quality. Liquid drop build up on the drop contact face of the catcher can adversely affect drop placement accuracy. For example, print drops can collide with liquid that accumulates on the drop contact face of the catcher. As such, there is an ongoing need to provide an improved catcher for these types of printing systems.

SUMMARY OF THE INVENTION

According to one aspect of the present invention, a method of printing provides liquid drops travelling along a first path using a jetting module. A catcher including a stationary porous surface is also provided. A liquid film is caused to flow over the stationary porous surface of the catcher using a liquid source. Selected liquid drops are caused to deviate from the first path and begin travelling along a second path using a deflection mechanism. The liquid drops travelling along one of the first path and the second path contact the liquid film.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
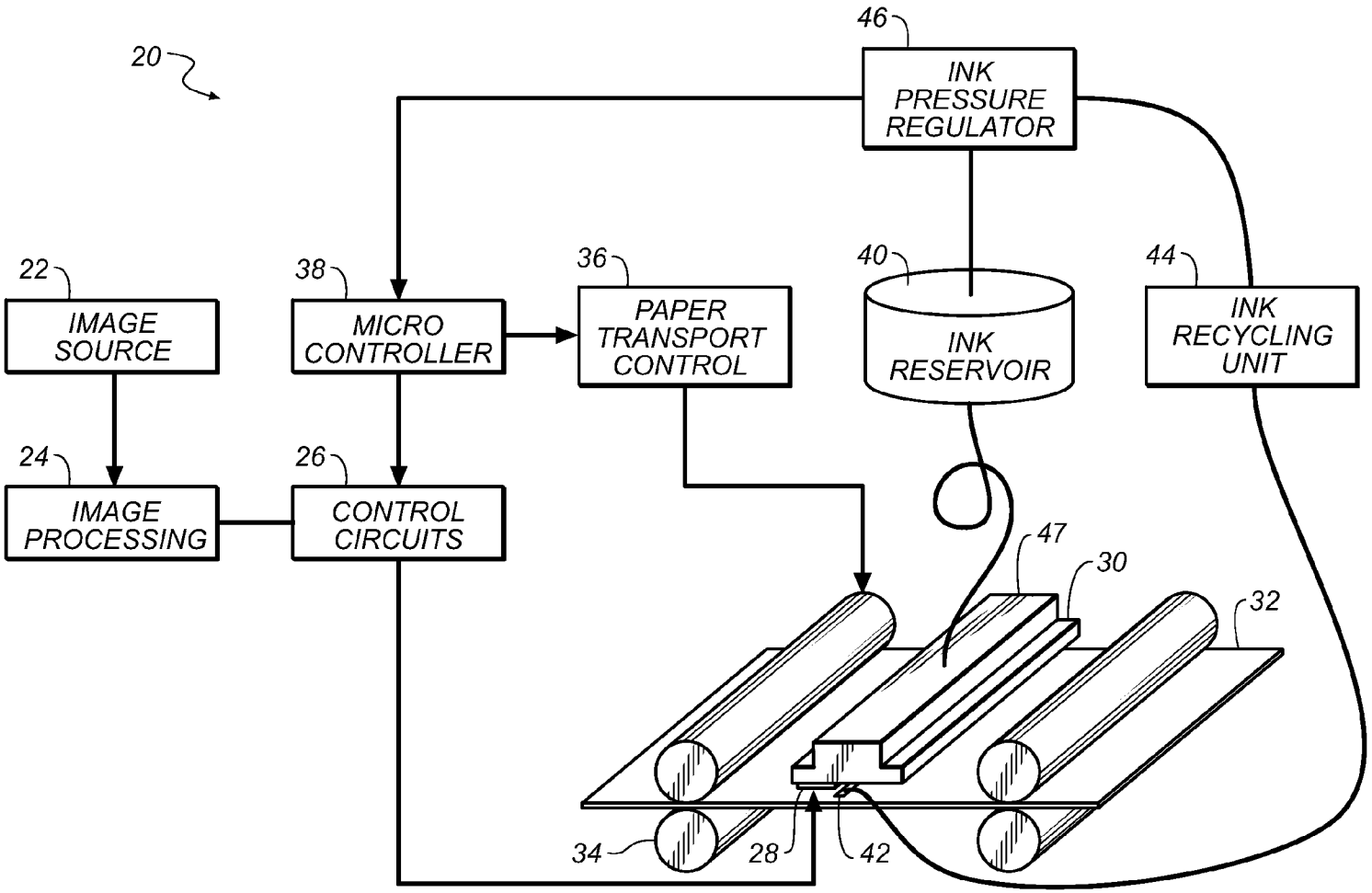
FIG. 1 is a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
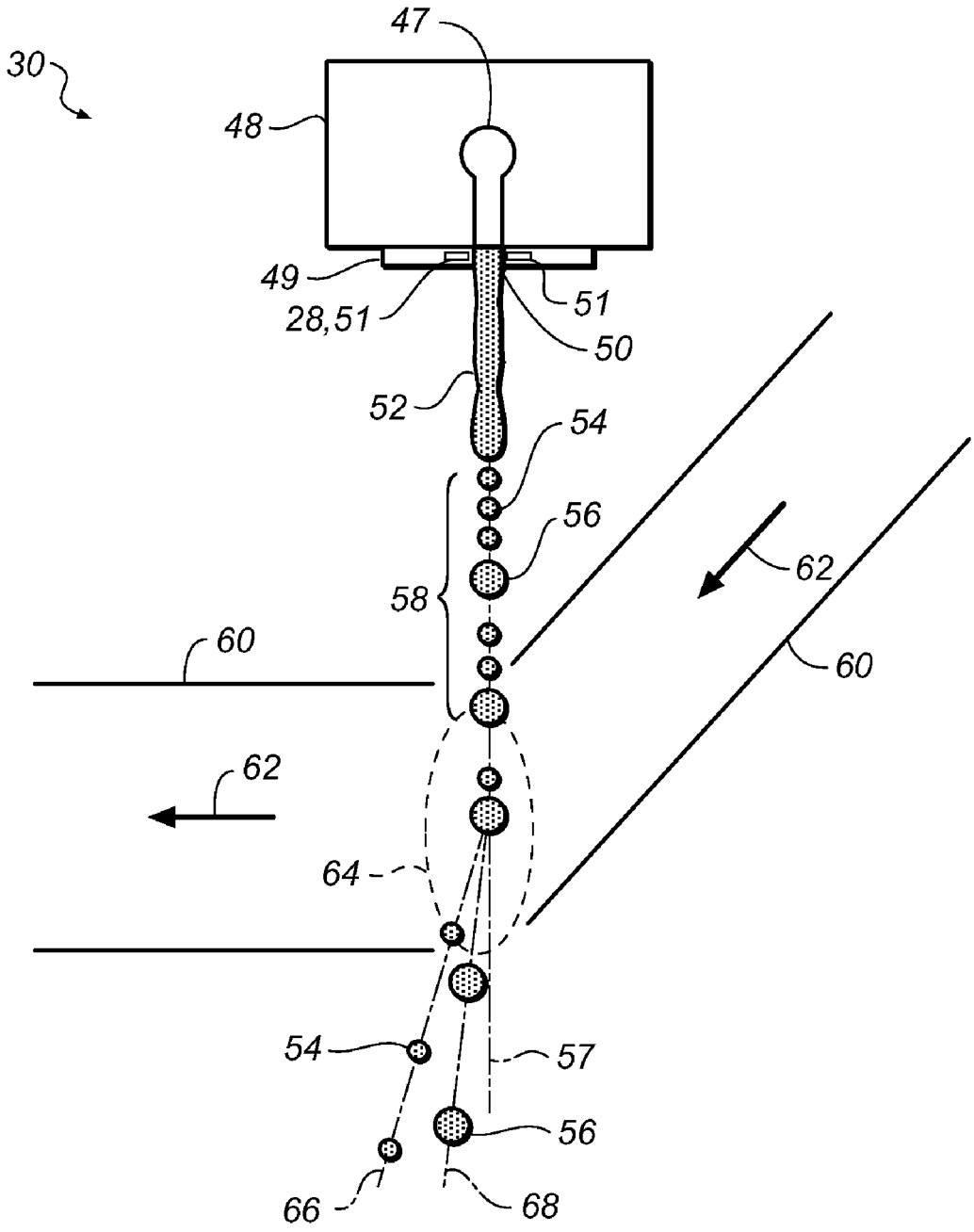
FIG. 2 is a schematic view of an example embodiment of a continuous printhead made in accordance with the present invention.
Figure 3:
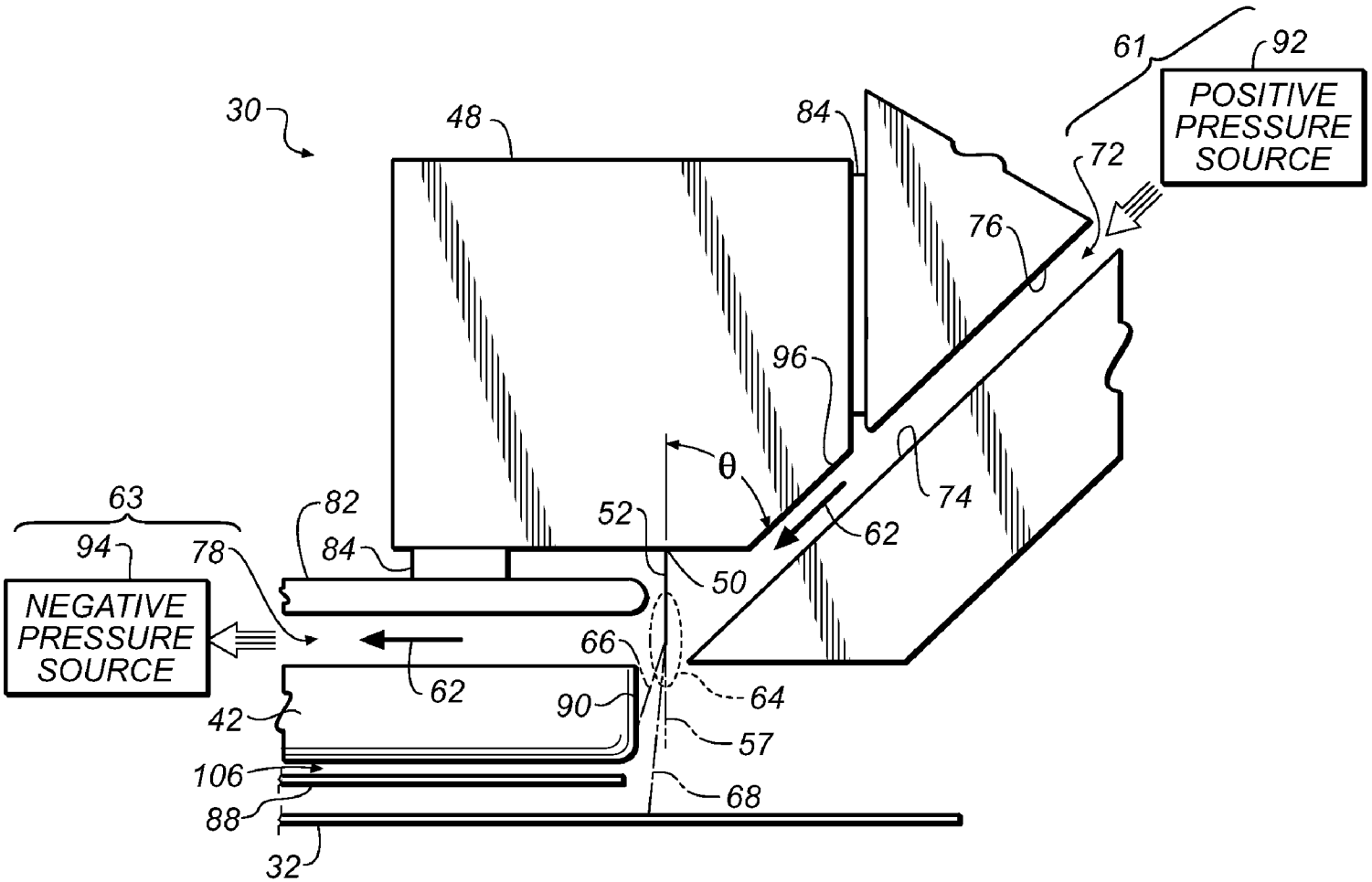
FIG. 3 is a schematic view of an example embodiment of a continuous printhead made in accordance with the present invention.

Referring to FIGS. 1 through 3, example embodiments of a printing system and a continuous printhead are shown that include the present invention described below. It is contemplated that the present invention also finds application in other types of continuous printheads or jetting modules. Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transfer system 34, which is electronically controlled by a recording medium transfer control system 36, and which in turn is controlled by a micro-controller 38. The recording medium transfer system shown in FIG. 1 is a schematic only, and many different mechanical configurations are possible. For example, a transfer roller could be used as recording medium transfer system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 and is supplied under sufficient pressure to the manifold 47 of the printhead 30 to cause streams of ink to flow from the nozzles of the printhead. In the non-printing state, continuous inkjet drop streams are unable to reach recording medium 32 due to a catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can include an ink pump control system.

The ink is distributed to printhead 30 through an ink manifold 47 which is sometimes referred to as a channel. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be an integral portion of the jetting module 48.

Liquid, for example, ink, is emitted under pressure through each nozzle 50 of the array to form streams, commonly referred to as jets or filaments, of liquid 52. In FIG. 2, the array or plurality of nozzles extends into and out of the figure. Typically, the orifice size of nozzle 50 is from about 5 μm to about 25 μm.

Jetting module 48 is operable to form liquid drops having a first size or volume and liquid drops having a second size or volume through each nozzle. To accomplish this, jetting module 48 includes a drop stimulation or drop forming device 28, for example, a heater, a piezoelectric actuator, or an electrohydrodynamic stimulator that, when selectively activated, perturbs each jet of liquid 52, for example, ink, to induce portions of each jet to break-off from the jet and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56 having a first size or volume, and small drops 54 having a second size or volume. The ratio of the mass of the large drops 56 to the mass of the small drops 54 is typically approximately an integer between 2 and 10. A drop stream 58 including drops 54, 56 follows a drop path or trajectory 57. Typically, drop sizes are from about 1 pL to about 20 pL.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike recording medium 32. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form jets of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the jet of liquid 52 to induce portions of the jet to break off from the jet to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately 45° relative to the stream of liquid 52 toward drop deflection zone 64 (also shown in FIG. 2). Optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. Optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 106 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32.

Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32. Alternatively, deflection can be accomplished by applying heat asymmetrically to a jet of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

Referring to FIGS. 4 through 10, example embodiments of the present invention are shown. Generally described, a printhead made in accordance with the present invention includes a jetting module that forms liquid drops travelling along a first path. A deflection mechanism causes selected liquid drops formed by the jetting module to deviate from the first path and begin travelling along a second path. A catcher includes a stationary porous surface. A liquid film flows over the stationary porous surface of the catcher. The catcher is positioned relative to the first path such that the liquid drops travelling along one of the first path and the second path contact the liquid film.

Figure 4:
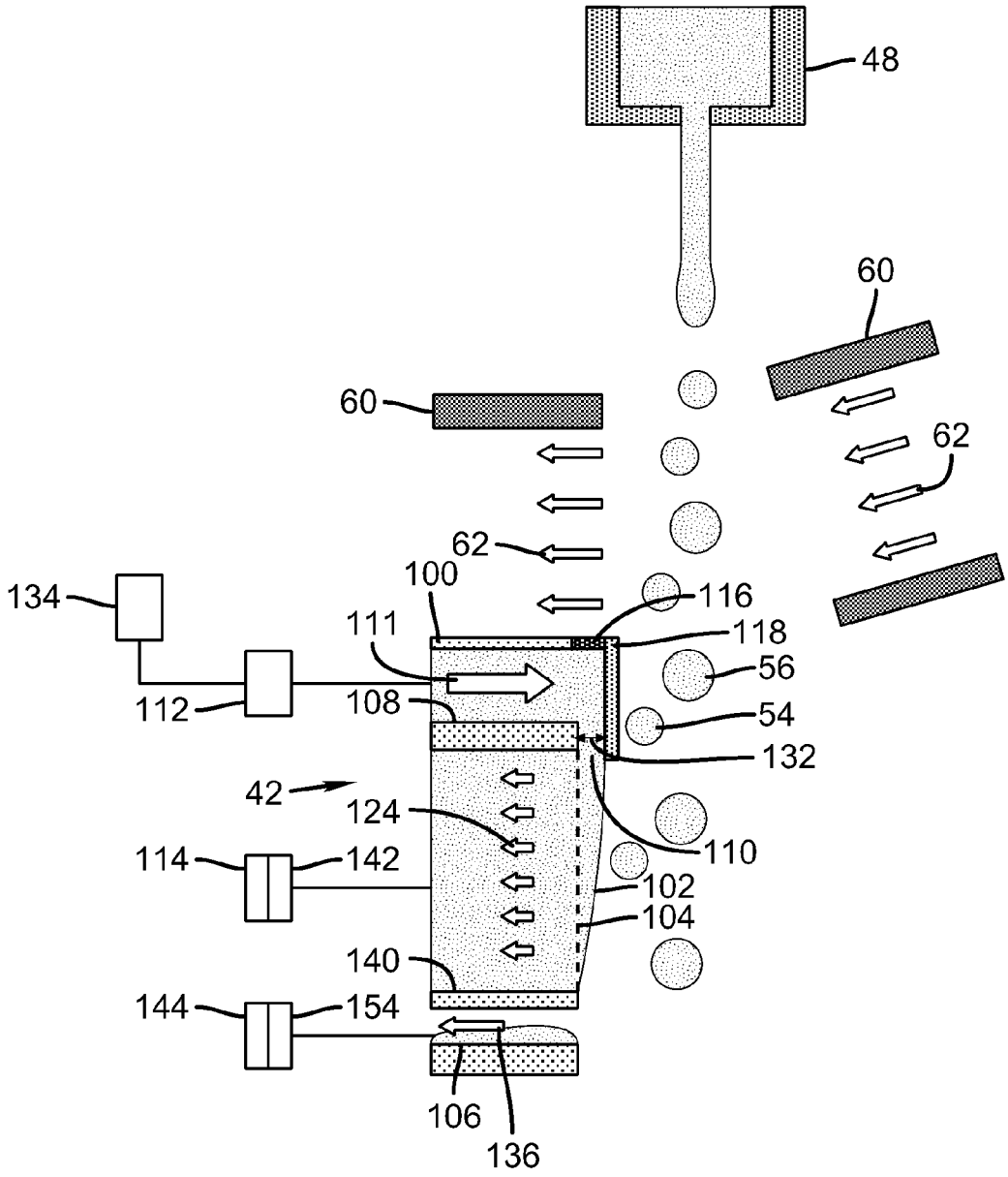
FIG. 4 is a schematic cross sectional view of a printhead including an example embodiment of the present invention.

Referring to FIG. 4, a cross-sectional view of printhead 30 including an example embodiment of the present invention is shown in more detail. As described above, jetting module 48 forms drops 54, 56 travelling along drop trajectory, first path 57 (shown in FIGS. 2 and 3). Gas flow deflection mechanism 60 deflects drops 54, 56 such that drops 54 begin travelling along small drop trajectory, second path 66 and drops 56 begin travelling along large drop trajectory 68 (either the first path or a third path that is slightly deflected relative to the first path as shown in FIGS. 2 and 3). Catcher 42, positioned downstream from gas flow deflection mechanism 60 relative to trajectory 57, includes a first liquid manifold 100, a moving liquid film 102, a stationary porous surface 104, and a second liquid manifold 140. First liquid manifold 100 includes a liquid inlet 108 and a liquid outlet 110. Liquid outlet 110 is formed by attaching a spacer 116 and a cover 118 to first liquid manifold 100. Cover 118 helps guide liquid toward stationary surface 104. Alternatively, liquid manifold 100 and cover 118 can be an integrally formed one piece structure. As shown in FIG. 4, catcher 42 includes a liquid return 106. Liquid return 106 is not required, however, in this example embodiment. As such, liquid return 106 is optional in the example embodiment shown in FIG. 4.

Liquid from a liquid source 112 of catcher 42 is pressurized using a pump, for example, or another type of liquid positive pressurization device 134 and provided to first liquid manifold 100 through liquid inlet 108. The pressurized liquid flows toward liquid outlet 110 (indicated in FIG. 4 by arrow 111). As the pressurized liquid exits first liquid manifold 100 through liquid outlet 110, moving liquid film 102 is created. Moving liquid film 102 flows over and is in contact with stationary porous surface 104 of catcher 42. As moving liquid film 102 continues along its travel path over stationary porous surface 104, the liquid of liquid film 102 begins to be absorbed by the pores of stationary porous surface 104. The liquid of liquid film 102 enters second liquid manifold 140 through the pores of stationary porous surface 104 (indicated in each FIG. by arrow 124). A vacuum source 114 applies a vacuum to second liquid manifold 140 to assist with liquid removal from second liquid manifold 140.

Vacuum source 114 is also in fluid communication with stationary porous surface 104 through second liquid manifold 140. Vacuum source 114 provides an amount of vacuum to stationary porous surface 104 to assist with liquid removal through and away from the pores of stationary porous surface 104. Vacuum source 114 includes a vacuum regulator 142 that controls the amount of vacuum provided to stationary porous surface 104. As shown in FIG. 4, vacuum regulator 142 controls the amount of vacuum provided to stationary porous surface 104 so that substantially all the liquid film is drawn into the porous catcher surface after liquid film 102 collects the liquid drops (drops 54 as shown in FIG. 4). This feature of the example embodiment shown in FIG. 4 helps to make the inclusion of liquid return 106 optional.

Depending on the specific application contemplated for catcher 42, vacuum regulator 142 controls the amount of vacuum provided to stationary porous surface 104 so that some of the liquid of liquid film 102 begins to be drawn into stationary porous surface 104 before liquid film 102 starts collecting the liquid drops. This helps to ensure that the liquid of liquid film 102 is absorbed through the pores of stationary porous surface 104 and helps make the inclusion of liquid return 106 optional.

When it is desired, however, to include liquid return channel 106 to receive excess liquid that may not be absorbed by the pores of porous surface 104 (in the unlikely event that this may occur), liquid return channel 106 is physically distinct from the pores of porous surface 104 of catcher 42. A vacuum source 144 can be included to apply a vacuum to liquid return 106 to assist with liquid removal (indicated in FIG. 4 by arrow 136) from liquid return 106. The amount of vacuum applied to liquid return 106 can be regulated using a vacuum regulator 154. Depending on the application, the transition from the porous surface 104 to the entrance to the liquid return channel can be rounded so that the liquid can be guided into the liquid return 106 utilizing the Coanda effect.

Moving liquid film 102 is positioned substantially parallel to trajectory (first path) 57. Typically, the angle between liquid curtain 102 and trajectory 57 is within ±20° from parallel. As liquid film 102 is moving or flowing over stationary porous surface 104 of catcher 42 the degree of parallelism depends on the shape of porous surface 104. In FIG. 4, porous surface 104 is substantially parallel to trajectory (first path) 57. Typically, the angle between stationary porous surface 104 and trajectory 57 is within ±20° from parallel. Non-printing drops, drops 54 as shown in FIG. 4, contact liquid film 102 in a drop contact region of liquid film 102. In this sense, liquid film 102 functions as the drop contact face 90 of catcher 42 (shown in FIG. 3). The drop contact region of liquid film 102 can be any portion of liquid film 102 between liquid outlet 110 and the downstream end, relative to trajectory 57, of stationary porous surface 104.

Liquid outlet 110 includes a width 132 dimension that extends in a direction substantially perpendicular to trajectory or first path 57. Outlet width 132 determines the thickness of liquid film 102. Outlet width 132 can vary and depends on the width of spacer 116. Typically, the thickness of moving (flowing) liquid film 102 is selected such that variations in the liquid resulting from the non-printing drops impacting liquid film 102 are small perturbations to liquid film 102 that have a minimal effect on the overall characteristics of liquid film 102. Typically, the liquid of liquid film 102 is the same liquid as that of the liquid drops 54, 56. However, the liquid used for liquid film 102 can be different than that of liquid drops 54, 56.

Figure 5:
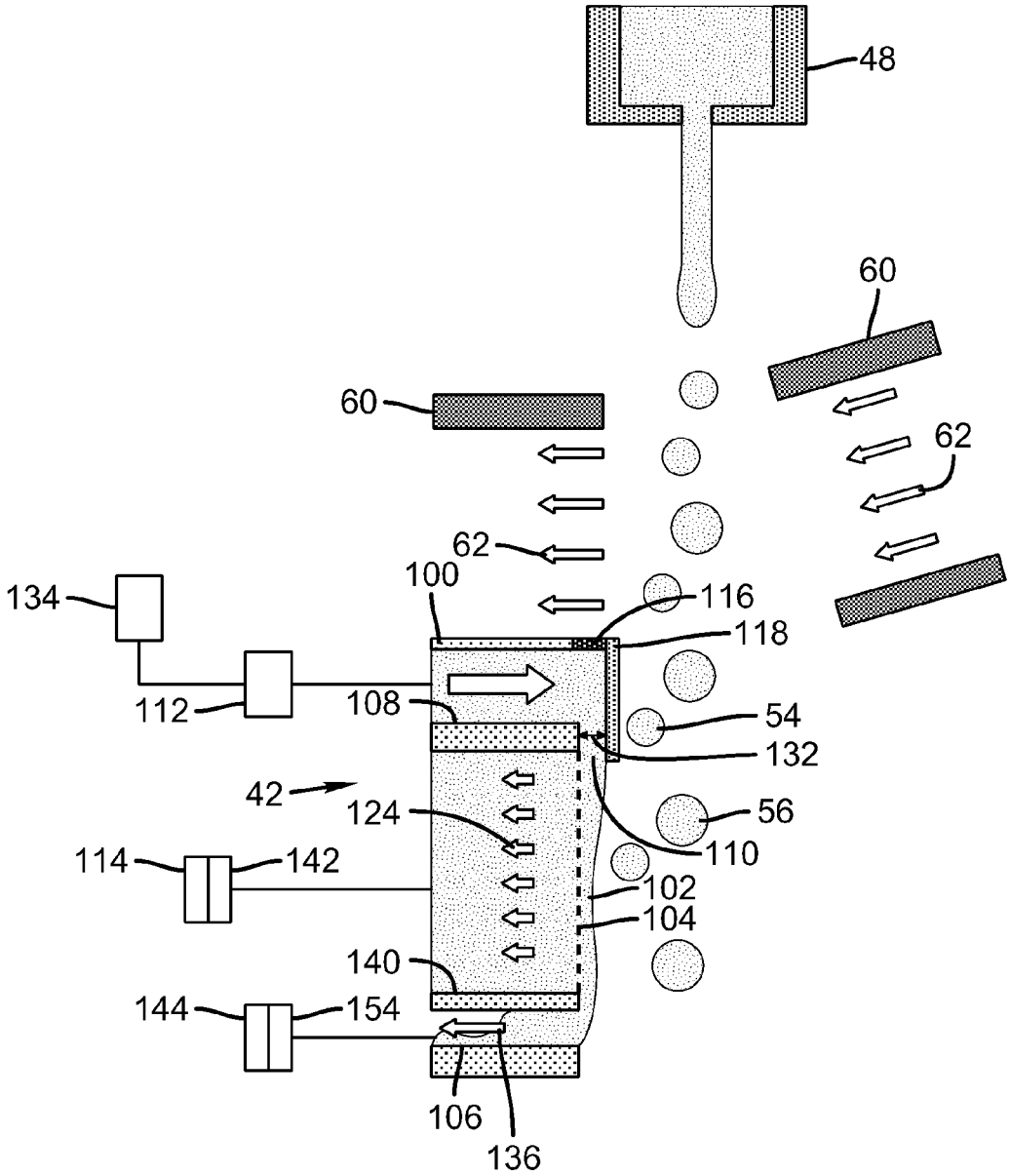
FIG. 5 is a schematic cross sectional view of a printhead including another example embodiment of the present invention.

Referring to FIG. 5, another example embodiment of catcher 42 is shown. Liquid return 106 is not optional in this example embodiment. As such, catcher 42 includes liquid return 106 in this example embodiment.

As described above, jetting module 48 forms drops 54, 56 travelling along drop trajectory, first path, 57 (as shown in FIGS. 2 and 3). Gas flow deflection mechanism 60 deflects drops 54, 56 such that drops 54 begin travelling along small drop trajectory, second path, 66 and drops 56 begin travelling along large drop trajectory 68 (either the first path or a third path that is slightly deflected relative to the first path as shown in FIGS. 2 and 3). Catcher 42, positioned downstream from gas flow deflection mechanism 60 relative to trajectory 57, includes a first liquid manifold 100, a moving liquid film 102, a stationary porous surface 104, and a second liquid manifold 140. First liquid manifold 100 includes a liquid inlet 108 and a liquid outlet 110. Liquid outlet 110 is formed by attaching a spacer 116 and a cover 118 to first liquid manifold 100. Cover 118 helps guide liquid toward stationary surface 104. Alternatively, liquid manifold 100 and cover 118 can be an integrally formed one piece structure. Catcher 42 also includes a liquid return 106.

Liquid from a liquid source 112 of catcher 42 is pressurized using a pump, for example, or another type of liquid positive pressurization device 134 and provided to first liquid manifold 100 through liquid inlet 108. The pressurized liquid flows toward liquid outlet 110 (indicated in each FIG. by arrow 111). As the pressurized liquid exits first liquid manifold 100 through liquid outlet 110, moving liquid film 102 is created. Moving liquid film 102 flows over and is in contact with stationary porous surface 104 of catcher 42. As moving liquid film 102 continues along its travel path over stationary porous surface 104, the liquid of liquid film 102 begins to be absorbed by the pores of stationary porous surface 104. The liquid of liquid film 102 enters second liquid manifold 140 through the pores of stationary porous surface 104 (indicated in FIG. 5 by arrow 124). A vacuum source 114 applies a vacuum to second liquid manifold 140 to assist with liquid removal from second liquid manifold 140.

Vacuum source 114 is also in fluid communication with stationary porous surface 104 through second liquid manifold 140. Vacuum source 114 provides an amount of vacuum to stationary porous surface 104 to assist with liquid removal through and away from the pores of stationary porous surface 104. Vacuum source 114 includes a vacuum regulator 142 that controls the amount of vacuum provided to stationary porous surface 104. As shown in FIG. 5, vacuum regulator 142 controls the amount of vacuum provided to stationary porous surface 104 so that some of the liquid of liquid film 102 is drawn into the porous catcher surface after liquid film 102 collects the liquid drops (drops 54 as shown in FIG. 5). Liquid return channel 106 receives the remainder of the liquid of liquid film 102 after liquid film 102 flows over the downstream end (relative to trajectory 57) of stationary porous surface 104 of catcher 42. Liquid return channel 106 is physically distinct from the pores of stationary porous surface 104 of catcher 42. Depending on the specific application contemplated for catcher 42, vacuum regulator 142 controls the amount of vacuum provided to stationary porous surface 104 so that some of the liquid of liquid film 102 begins to be drawn into stationary porous surface 104 before liquid film 102 starts collecting the liquid drops.

A vacuum source 144 is typically included to apply a vacuum to liquid return 106 to assist with liquid removal (indicated in FIG. 5 by arrow 136) from liquid return 106. When the liquid of the liquid film is the same liquid as that of the liquid drops (printed or non-printed), liquid return channel 106 typically returns the liquid to recycling unit 44 so that the liquid can be used again. Alternatively, liquid return channel 106 can deliver the liquid to a storage container so that it can be discarded. The amount of vacuum applied to liquid return 106 can be regulated using a vacuum regulator 154.

Moving liquid film 102 is positioned substantially parallel to trajectory (first path) 57. Typically, the angle between liquid curtain 102 and trajectory 57 is within ±20° from parallel. As liquid film 102 is moving or flowing over stationary porous surface 104 of catcher 42 the degree of parallelism depends on the shape of porous surface 104. In FIG. 5, porous surface 104 is substantially parallel to trajectory (first path) 57. Typically, the angle between stationary porous surface 104 and trajectory 57 is within ±20° from parallel. Non-printing drops, drops 54 as shown in FIG. 5, contact liquid film 102 in a drop contact region of liquid film 102. In this sense, liquid film 102 functions as the drop contact face 90 of catcher 42 (shown in FIG. 3). The drop contact region of liquid film 102 can be any portion of liquid film 102 between liquid outlet 110 and the downstream end, relative to trajectory 57, of stationary porous surface 104.

Liquid outlet 110 includes a width 132 dimension that extends in a direction substantially perpendicular to trajectory or first path 57. Outlet width 132 determines the thickness of liquid film 102. Outlet width 132 can vary and depends on the width of spacer 116. Typically, the thickness of moving (flowing) liquid film 102 is selected such that variations in the liquid resulting from the non-printing drops impacting liquid film 102 are small perturbations to liquid film 102 that have a minimal effect on the overall characteristics of liquid film 102. Typically, the liquid of liquid film 102 is the same liquid as that of the liquid drops 54, 56. However, the liquid used for liquid film 102 can be different than that of liquid drops 54, 56.

Referring to FIGS. 6 through 10, additional example embodiments of the present invention are shown. These embodiments are interchangeable with the embodiments described with reference to FIGS. 4 and 5 and can be implemented separately or in combination with one or more embodiments. For example, in any or all of the example embodiments described herein, stationary porous surface 104 of catcher 42 can be hydrophilic in order to help control liquid film 102 thickness and absorption rates through porous surface 104.

Figure 6:
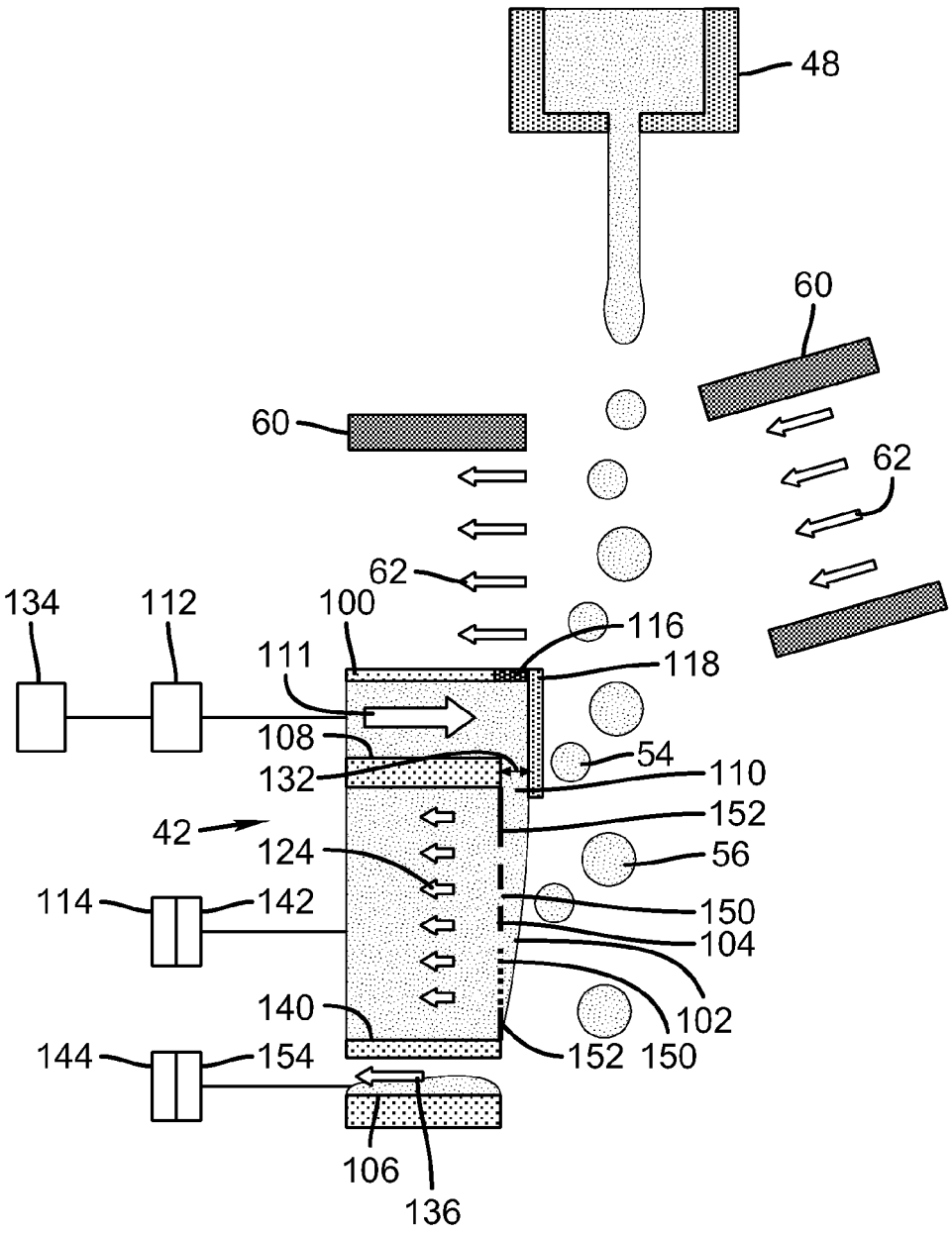
FIG. 6 is a schematic cross sectional view of a printhead including another example embodiment of the present invention.
Figure 7A:
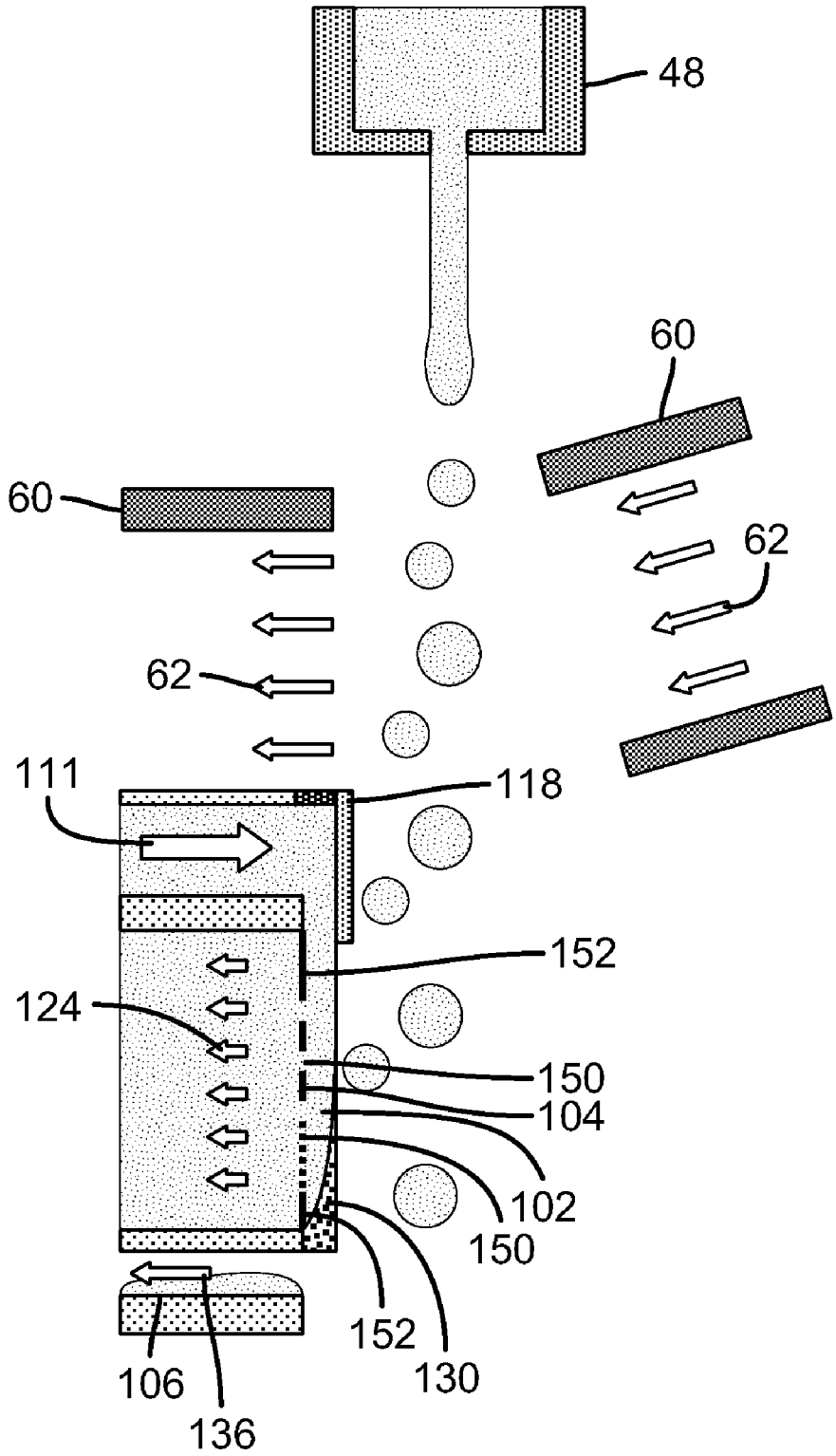
FIG. 7A is a schematic cross sectional view of a printhead including another example embodiment of the present invention.
Figure 7B:
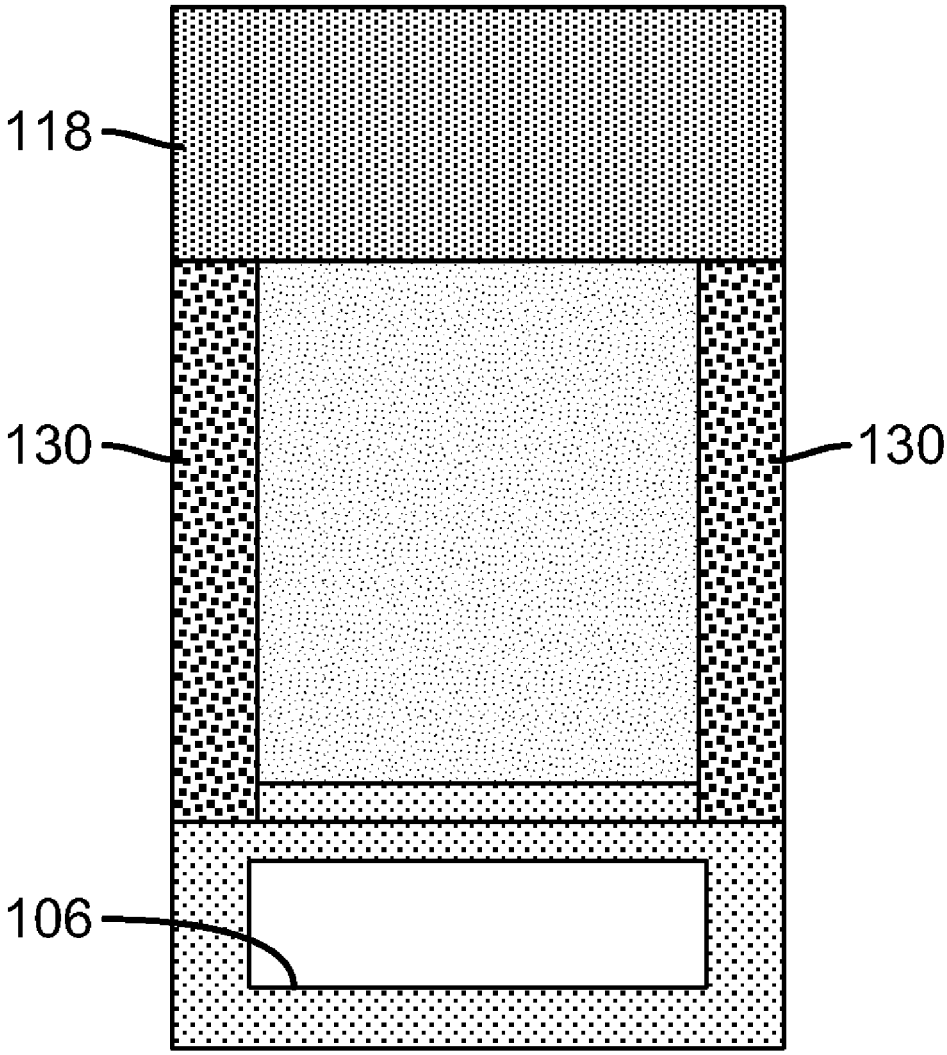
FIG. 7B is a schematic front view of the catcher of the example embodiment shown in FIG. 7A.

In FIG. 6, the pores 150 of stationary porous surface 104 have more than one pore size when compared to each other. Stationary porous surface 104 also includes a non-porous section 152 located therein. Through the inclusion of a non-porous section 152 and pores of varying diameters, it is possible tailor the liquid absorption through the stationary porous surface 104 across the height and width of the catcher face in such a way as to produce a moving liquid film 102 having thickness and velocity down the catcher face in the drop impact zone of the catcher across the entire width of the nozzle array. Liquid film 102 includes a width dimension that typically extends beyond nozzle array 50. However, in some example embodiments of the present invention, catcher 42 includes structure 130 positioned to maintain the width of liquid film 102 as liquid film 102 flows over porous surface 104 of catcher 42. Typically, liquid film 102 extends beyond both ends nozzle array 50 of jetting module 48. Maintaining the width of liquid film 102, using edge guides as shown in FIGS. 7A and 7B, for example, helps to ensure that liquid film 102 has consistent liquid properties, in particular, thickness and velocity, from one end of the liquid film to the other end of the liquid film so that non-printing drops encounter the same consistency of moving liquid film regardless of where contact with liquid film 102 occurs.

Figure 8:
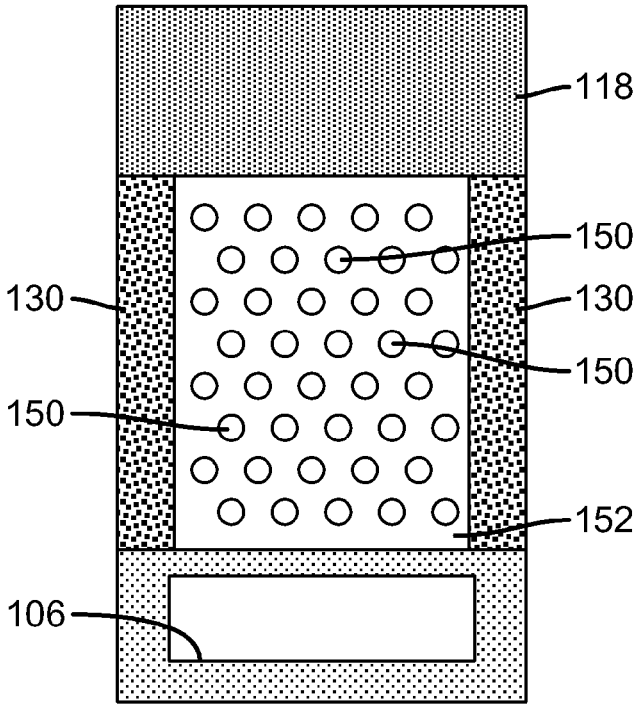
FIG. 8 is a schematic front view of another example embodiment of the present invention.
Figure 9:
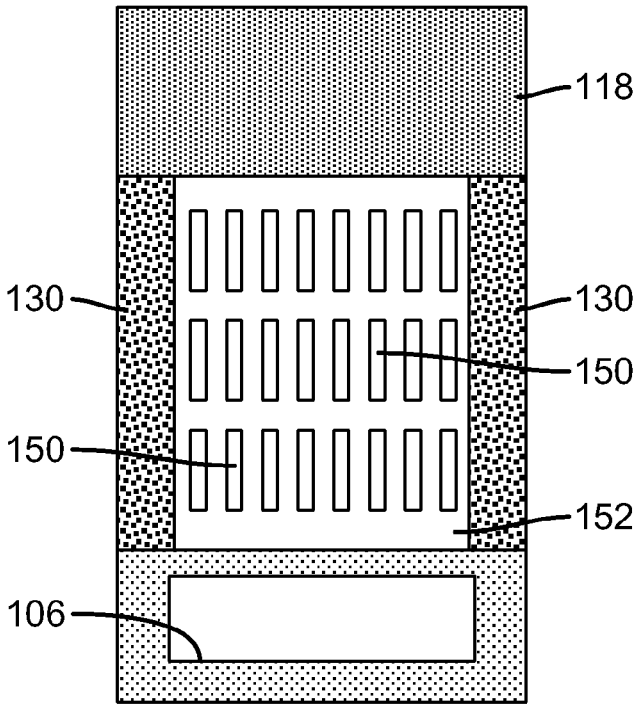
FIG. 9 is a schematic front view of another example embodiment of the present invention.

Referring to FIGS. 8 and 9, pores 150 are arranged in a two dimensional pattern. In FIG. 8, pores 150 have a circular shape. In FIG. 9, pores 150 have a rectangular shape. In both figures, each of the plurality of pores 150 has a substantially uniform size when compared to each other. Additionally, each of the plurality of pores 150 has a critical pressure point above which air can displace liquid from the plurality of pores. Accordingly, in some applications, a vacuum regulator 142 (shown in FIGS. 4 and 5) is used to control the vacuum applied to the plurality of pores 150 so that the amount of vacuum applied to the plurality of pores 150 remains below the critical pressure point of the plurality of pores 150 of the porous surface 104 of catcher 42. Controlling the negative pressure (or vacuum) applied to the back of porous surface 104 helps to continuously remove liquid from porous surface 104 through second liquid manifold 140. This also helps to keep second liquid manifold 140 and the pores 150 of porous surface 104 filled with liquid from the liquid film 102 and liquid drops. Maintaining the applied negative pressure below the bubble point of the pores 150 of porous surface 104 helps to reduce the likelihood of air being ingested into second manifold 140 of catcher 42. As described above, vacuum source 114 is in fluid communication with the plurality of pores 150 of porous surface 104 of catcher.

Figure 10:
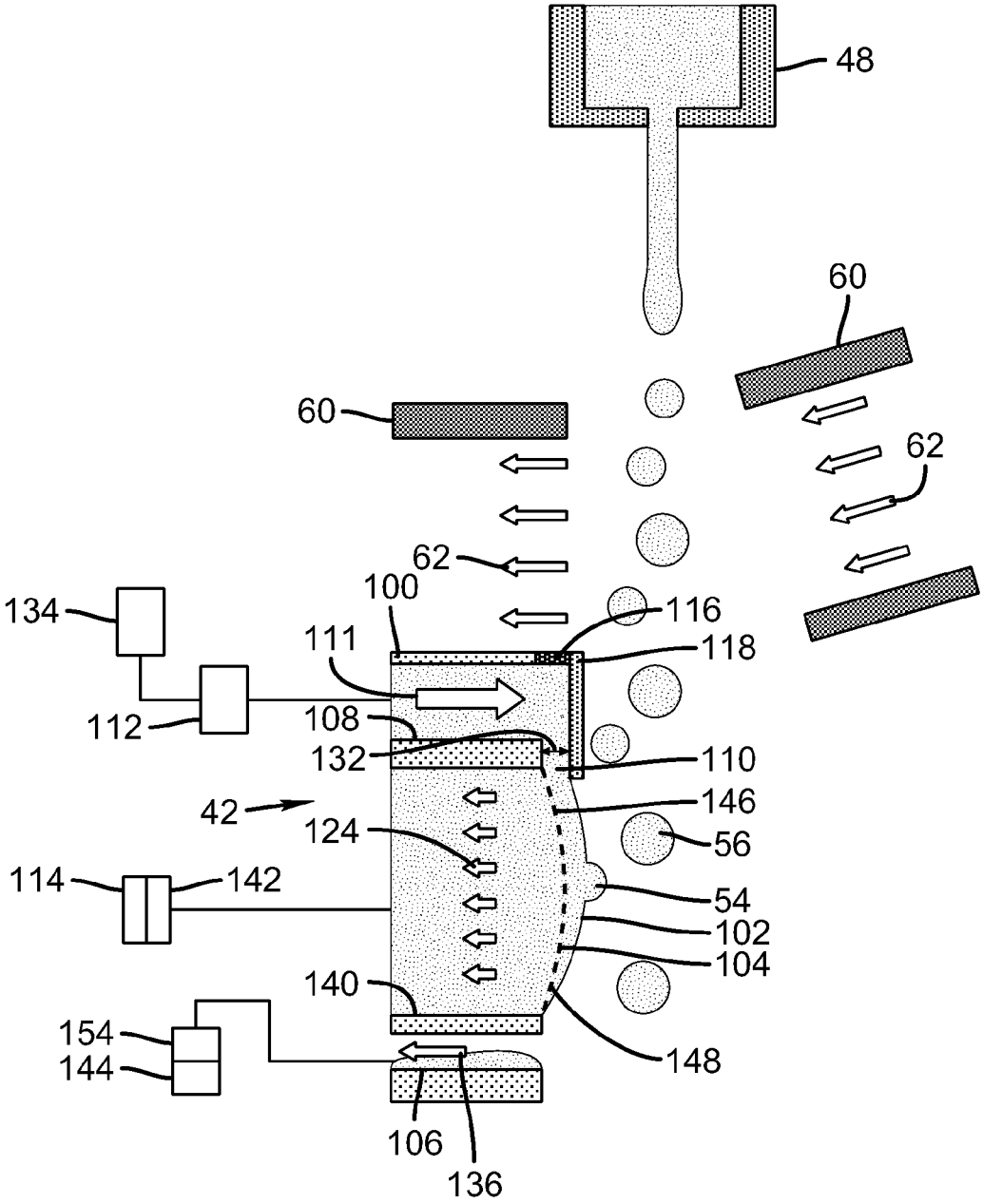
FIG. 10 is a schematic cross sectional view of a printhead including another example embodiment of the present invention.

In FIG. 10, stationary porous surface 104 is convex toward trajectory (first path) 57 in contrast to the flat porous surfaces 104 shown with reference to FIGS. 4 and 5. Accordingly, a portion (either or both of 146 and 148) of stationary porous surface 104 of catcher 42 curves away from the first path when viewed from the first path. This helps to control the thickness of liquid film 102.

Referring back to FIGS. 4 through 10, liquid film 102 exits liquid outlet 110 at a velocity. The specific velocity typically depends on the application contemplated with several factors taken into consideration. These factors can include, for example, print speed, printed liquid, for example, ink, characteristics, and desired image quality. Printhead 30 includes a mechanism that regulates the velocity of liquid film 102. This mechanism can be the device, for example, the pump, that pressurizes the liquid that forms liquid film 102. Regulation of the velocity of the liquid film can occur continuously throughout the printing operation such that the velocity is changed more then once depending on printing conditions. Alternatively, regulation of the velocity can occur once, typically, at the beginning of a printing operation. Regulation of the velocity of liquid film 102 can occur before liquid film flows over porous surface 104 of catcher. Preferably, the velocity of the moving liquid film is within ±50% of the velocity of the collected drops and, more preferably, the velocity of the moving liquid film is substantially the same as the speed of the collected drops and, more preferably, the velocity of the flowing liquid film is the same as the component of the drop velocity in the direction of liquid film flow. Preferably the liquid film 102 thickness above the drop contact zone is between 15 micron and 100 micron. More preferably the liquid film thickness above the drop contact zone is between 30 micron and 75 micron. If the liquid film thickness is too small, however, the liquid film can slow down excessively as it moves down the catcher face and can as a result begin to bulge out excessively toward the drop trajectories. Alternatively, if the liquid film thickness is too large, waves in the surface of the liquid film produced by drops impacting the liquid film can reduce the drop deflection operating latitude of the printhead.

The moving liquid film catcher of the present invention is also suitable for use when high viscosity liquids are being supplied to and ejected by printhead 30. In applications where a high viscosity liquid is being used for the print and non-print liquid drops, the viscosity of liquid film 102 can be lower than the viscosity of the liquid drops. This is done to facilitate movement of the higher viscosity print and non-print liquid drops along the porous surface 104 of catcher 42. A heater can be incorporated into the liquid source 112 to heat the supplied to the liquid manifold 100 and thereby lower the viscosity of the liquid film liquid. Alternatively, the catcher 42 or the liquid manifold 100 can include heaters to heat the liquid as it passes through the liquid manifold 100. In another embodiment, the liquid supplied to the liquid manifold can be distinct from the liquid of the print and non-print drops, the liquid supplied to the liquid manifold having the lower viscosity.

Referring back to FIGS. 1-10, a printing operation of the printing system 20 will be described. Liquid drops are provided travelling along a first path using a jetting module. A catcher including a stationary porous surface is also provided. A liquid film is caused to flow over the stationary porous surface of the catcher using a liquid source. Selected liquid drops are caused to deviate from the first path and begin travelling along a second path using a deflection mechanism. The liquid drops travelling along one of the first path and the second path contact the liquid film.

An amount of vacuum can be provided to the porous catcher surface using a vacuum source that is in fluid communication with the porous surface of the catcher. The amount of vacuum provided to the porous catcher surface can be controlled using a vacuum regulator so that substantially all the liquid film is drawn into the porous catcher surface after the liquid film has collected the liquid drops. Optionally, the catcher can include a liquid return channel that is physically distinct from the porous surface of the catcher. Excess liquid film from the stationary porous surface of the catcher, if there is any, can be received by the liquid return channel. Controlling the amount of vacuum provided to the porous catcher surface can include drawing some of the liquid film into the porous catcher surface before the liquid film starts collecting the liquid drops.

Alternatively, an amount of vacuum can be provided to the porous catcher surface using a vacuum source that is in fluid communication with the porous surface of the catcher. The amount of vacuum provided to the porous catcher surface can be controlled using a vacuum regulator so that some of the liquid film is drawn into the porous catcher surface after the liquid film has collected the liquid drops. A liquid return channel receives the remainder of the liquid film after the liquid film flows over the stationary porous surface of the catcher. The liquid return channel can be physically distinct from the porous surface of the catcher.

The porous surface of the catcher can include a plurality of pores with each of the plurality of pores having a substantially uniform size when compared to each other and each of the plurality of pores having a critical pressure point above which air can displace liquid from the plurality of pores. A vacuum source can be provided in fluid communication with the plurality of pores of the porous surface of the catcher. The vacuum applied to the plurality of pores can be controlled using a vacuum regulator so that the amount of vacuum applied to the plurality of pores remains below the critical pressure point of the plurality of pores of the porous surface of the catcher. The plurality of pores can be arranged in a two dimensional pattern.

The velocity of the liquid film can be regulated using a regulating mechanism. This mechanism can be the device, for example, the pump, that pressurizes the liquid that forms liquid film. Regulation of the velocity of the liquid film can occur throughout the printing operation such that the velocity is changed more then once depending on printing conditions. Alternatively, regulation of the velocity can occur once, typically, at the beginning of a printing operation. Velocity regulation can occur before the liquid film flows over the porous surface of the catcher. Preferably, the velocity of the moving liquid film at the location of drop collection is within ±50% of the velocity of the collected drops and, more preferably, the velocity of the moving liquid film is substantially the same as the speed of the collected drops and, more preferably, the velocity of the flowing liquid film is the same as the component of the drop velocity in the direction of liquid film flow. In some applications, the viscosity of the liquid film is lower than the viscosity of the print non-print liquid drops.

In some example embodiments, providing the moving liquid film includes positioning the moving liquid film substantially parallel relative to the first path. In the same or other example embodiments, the width of the liquid film is maintained using suitably designed structures or devices. Typically, it is preferable that the liquid of the liquid film is the same liquid as that of the liquid drops. The porous surface of the catcher can be hydrophilic. A non-porous section can be located on the surface of the catcher that also includes the porous surface. The porous surface of the catcher can be flat or a portion of the surface of the catcher can curve away from the first path when viewed from the first path. Catcher face 90 can include features to reduce the drag of the liquid flowing down across the surface. Examples of drag reducing features are discussed in commonly assigned U.S. patent application Ser. No. 12/504,050, entitled "Catcher Including Drag Reducing Drop Contact Surface," incorporated herein by reference.

The example embodiments of catcher 42 can be made using conventional fabrication techniques. For example, porous surface 104, spacer 116, or cover 118 can be made of photo etched stainless steel, electroformed Ni, or laser abated metal, ceramics, or plastics. Alternatively, the components of catcher 42 can be made using conventional MEMS processing techniques in silicon or other suitable materials.

The invention has been described in detail with particular reference to certain preferred embodiments thereof, but it will be understood that variations and modifications can be effected within the scope of the invention.

PARTS LIST

20 continuous printing system
22 image source
24 image processing unit
26 mechanism control circuits
28 device
30 printhead
32 recording medium
34 recording medium transfer system
36 recording medium transfer control system
38 micro-controller
40 reservoir
42 catcher
44 recycling unit
46 pressure regulator
47 manifold
48 jetting module
49 nozzle plate
50 nozzle
51 heater
52 liquid
53 liquid chamber
54 drops
56 drops
57 trajectory
58 drop stream
60 gas flow deflection mechanism
61 positive pressure gas flow structure
62 gas
63 negative pressure gas flow structure
64 deflection zone
66 small drop trajectory
68 large drop trajectory
72 first gas flow duct
74 lower wall
76 upper wall
78 second gas flow duct
82 upper wall

84 seal
88 plate
90 catcher face
92 positive pressure source
94 negative pressure source
96 wall
100 first liquid manifold
102 moving liquid film
104 stationary porous surface
106 liquid return
108 liquid inlet
110 liquid outlet
111 arrow
112 liquid source
114 vacuum source
116 spacer
118 cover
124 arrow
130 structure
132 outlet width
134 liquid pressurization device
136 arrow
140 second liquid manifold
142 vacuum regulator
144 vacuum source
146 catcher portion
148 catcher portion
150 pores
152 non-porous section of porous surface of catcher
154 vacuum regulator

The invention claimed is:

1. A method of printing comprising:

providing liquid drops travelling along a first path using a jetting module;

providing a catcher including a stationary porous surface and a liquid source that provides pressurized liquid to the catcher;

causing a liquid film to flow over the stationary porous surface of the catcher using the pressurized liquid provided by the liquid source of the catcher; and causing selected liquid drops to deviate from the first path and begin travelling along a second path using a deflection mechanism such that the liquid drops travelling along one of the first path and the second path contact the liquid film.

2. The method of claim 1, wherein causing the liquid film to flow over the stationary porous surface of the catcher includes causing the liquid film to flow substantially parallel to the first path.

3. The method of claim 1, further comprising:

providing an amount of vacuum to the porous catcher surface using a vacuum source that is in fluid communication with the porous surface of the catcher; and controlling the amount of vacuum provided to the porous catcher surface using a pressure regulator such that substantially all the liquid film is drawn into the porous catcher surface after the liquid film has collected the liquid drops.

4. The method of claim 3, wherein controlling the amount of vacuum provided to the porous catcher surface includes drawing some of the liquid film into the porous catcher surface before the liquid film starts collecting the liquid drops.

5. The method of claim 3, the catcher including a liquid return channel that is physically distinct from the porous surface of the catcher, further comprising causing the liquid return channel to receive excess liquid film from the stationary porous surface of the catcher.

6. The method of claim 1, further comprising:

providing an amount of vacuum to the porous catcher surface using a vacuum source that is in fluid communication with the porous surface of the catcher; and controlling the amount of vacuum provided to the porous catcher surface using a pressure regulator such that some of the liquid film is drawn into the porous catcher surface after the liquid film has collected the liquid drops.

7. The method of claim 6, the catcher including a liquid return channel, further comprising causing the liquid return channel to receive the remainder of the liquid film after the liquid film flows over the stationary porous surface of the catcher.

8. The method of claim 7, wherein the liquid return channel is physically distinct from the porous surface of the catcher.

9. The method of claim 1, the liquid film including a width, further comprising maintaining the width of the liquid film as the liquid film flows over the stationary surface of the catcher.

10. The method of claim 1, the liquid film travelling at a velocity, further comprising regulating the velocity of the liquid film before the liquid film flows over the surface of the catcher.

11. The method of claim 1, wherein a portion of the surface of the catcher curves away from the first path.

12. The method of claim 1, the porous surface of the catcher including a plurality of pores, each of the plurality of pores having a substantially uniform size when compared to each other, the plurality of pores having a critical pressure point above which air can displace liquid from the plurality of pores, the method further comprising:

providing a vacuum source in fluid communication with the plurality of pores of the porous surface of the catcher; and controlling the vacuum applied to the plurality of pores using a pressure regulator such that the amount of vacuum applied to the plurality of pores remains below the critical pressure point of the plurality of pores of the porous surface of the catcher.

13. The method of claim 12, wherein the plurality of pores are arranged in a two dimensional pattern.

14. The method of claim 12, wherein the porous surface of the catcher is hydrophilic.

15. The method of claim 1, the catcher further comprising:

a non-porous section located on a surface of the catcher that also includes the porous surface of the catcher.

16. The method of claim 1, wherein the liquid of the liquid film is the same liquid as that of the liquid drops.

17. The method of claim 1, the liquid film flowing at a velocity, wherein the velocity of the liquid film is substantially the same as the velocity of the collected drops.

18. The method of claim 1, the liquid film flowing at a velocity, wherein the velocity of the liquid film is within ±50% of the velocity of the collected drops.

19. The method of claim 1, the liquid film having a viscosity, wherein the viscosity of the liquid film is lower than the viscosity of the liquid drops.

* * * * *